United States Patent [19]

Zelenka et al.

[11] Patent Number: 4,872,583

[45] Date of Patent: Oct. 10, 1989

[54] HANDLE STRUCTURE FOR PAINT CONTAINER

[76] Inventors: Zdenek Zelenka; Lyn Zelenka, both of #66-9633-180 St., Edmonton, Alberta, Canada, T5T 4G4

[21] Appl. No.: 199,051

[22] Filed: May 26, 1988

[51] Int. Cl.[4] ..... B65D 25/28

[52] U.S. Cl. ..... 220/94 R; 220/85 D; 248/110

[58] Field of Search ..... 220/94 R, 96, 85 D; 248/110, 111

[56] References Cited

U.S. PATENT DOCUMENTS

| | | | |
|---|---|---|---|
| 337,660 | 3/1886 | Campbell | 220/85 D |
| 2,487,516 | 7/1946 | Braswell | 248/110 |
| 2,498,511 | 3/1946 | Smith | 220/85 D |
| 2,578,233 | 3/1947 | Entminger | 248/110 |
| 2,625,299 | 1/1953 | Uhlig | 248/110 |
| 2,786,707 | 3/1957 | Campbell | 220/85 D |
| 2,788,153 | 4/1957 | Broadbelt | 248/110 |
| 3,346,906 | 10/1967 | Harrison et al. . | |
| 3,729,158 | 4/1973 | Nagy . | |

*Primary Examiner*—Stephen Marcus
*Assistant Examiner*—Gilbert W. Reece

[57] ABSTRACT

A handle structure for a paint container, whereby the container can be safely held with one hand while dipping a brush into the container with the other hand. A threaded bolt means is actuable to draw a clamping component toward the handle structure for clamping the container securely to the handle structure. A section of the handle structure engages an outer side surface of the container to prevent the container from wobbling or deforming.

1 Claim, 1 Drawing Sheet

HANDLE STRUCTURE FOR PAINT CONTAINER

BACKGROUND OF INVENTION

Homeowners and professional painters often apply paint or other liquid coating materials directly from the original container (can) onto the surface to be coated (e.g. item of furniture, wall surface, etc.). The can is held in one hand while a paint brush is held in the other hand to transfer the liquid from the can onto the surface to be coated.

A quart paint can has a diameter that is somewhat greater than the normal gripping capacity of an average person. The person's thumb and fingers can only curl around approximately one half the can circumference. It becomes difficult for the average person to maintain a grasp on the container for an extended period of time (needed to complete a painting operation).

The gripping problem has been addressed in U.S. Pat. No. 2,788,153 issued to H. L. Broadbelt. That patent discloses a handle structure having a hook extension designed to snap over (around) the container rim to frictionally retain the handle in spaced relation to the can side surface. The user is able to easily grasp (grip) the pistol-type handle structure and thereby maintain the paint can in a desired (convenient) position during the painting operation.

The hook extension shown in the Broadbelt patent relies on spring characteristics of the hook material to maintain a clamping force on the container rim.

SUMMARY OF INVENTION

Our invention relates to an improvement on the handle structure shown in the Broadbelt patent. In our concept the handle structure comprises a handle component and a separate clamping component. A threaded connector means extends through these two components to draw them together for exerting a dependable clamp force on the ca rim structure.

Our improved handle structure is designed to provide a rigid and reliable connection with the paint can, whereby the user is reassured that the handle structure will not inadvertantly be dislodged from the can, e.g. when the brush is impacted on the can surface to remove excess paint, or when the can is bumped forcefully against a ladder, etc.

To expand the utility of the handle structure, we have incorporated into its design an integral lid opener and brush support. The built-in lid opener will be used when the can is to be initially opened, and also later when the can is to be re-opened after temporary or prolonged storage between painting operations. The brush support provides a temporary support for holding the brush in a prone position above the can, e.g. for draining excess paint back into the can while the user's hands are occupied in related tasks, e.g. cleaning or sanding.

THE DRAWINGS

DESCRIPTION OF A PREFERRED EMBODIMENT

Figure 1:
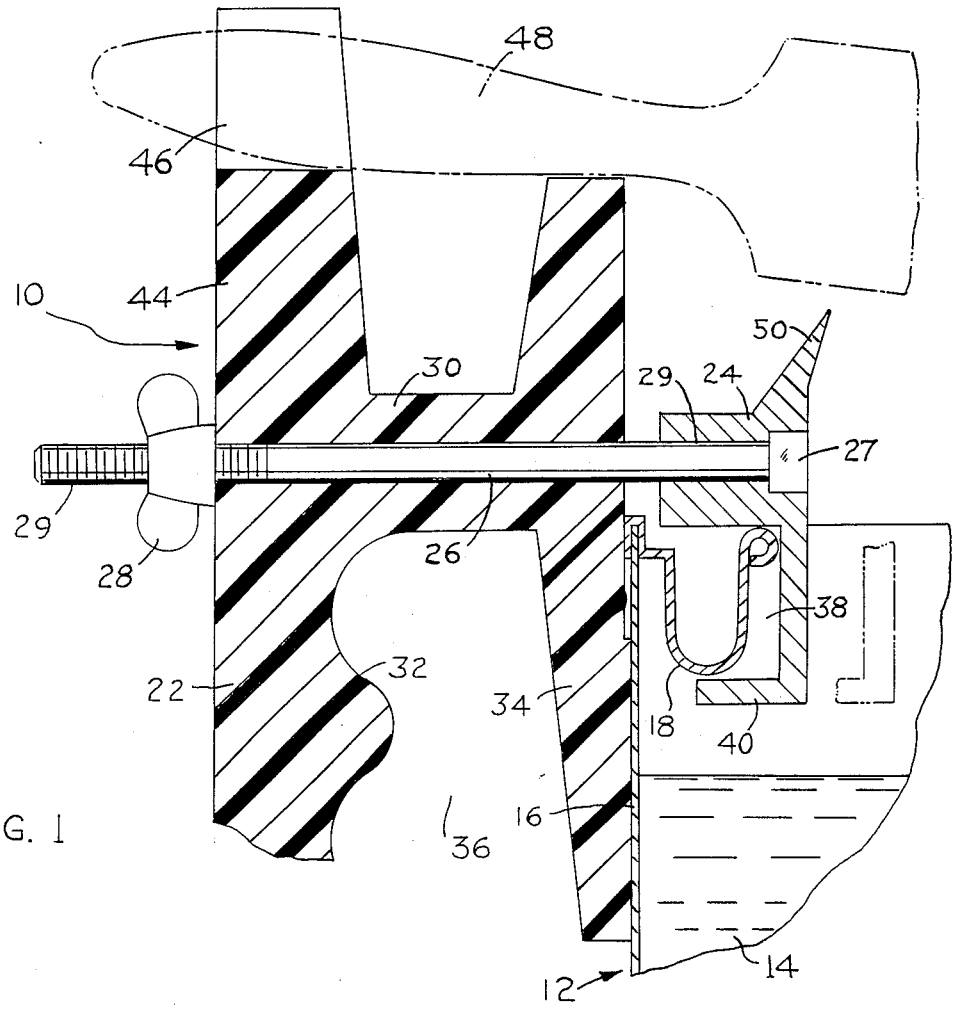
FIG. 1 is a sectional view taken through a device embodying our invention. The device is shown installed on a paint container.
Figure 2:
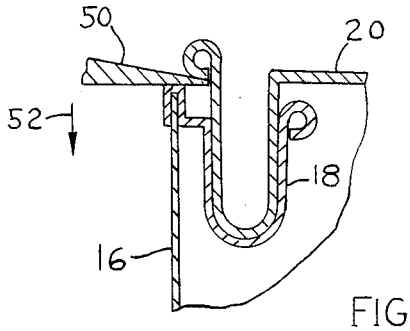
FIG. 2 is a fragmentary view illustrating the FIG. 1 device when employed as a lid opener.

FIG. 1 shows a handle structure 10 installed on a container 12 for paint, varnish or other liquid coating material 14. The container includes a cylindrical upright side wall 16 that terminates in an inwardly radiating rim structure 18. Rim structure 18 circumscribes a central opening that is normally closed by a cover 20 (FIG. 2). Cover 20 is removed during periods when the paint brush is being inserted into the container to remove liquid for application onto a surface to be coated.

Handle structure 10 comprises a handle component 22, a separate clamping component 2, and a threaded connector means (bolt and nut) 26. The components are designed and oriented so that manual rotation of wing nut 28 draws clamping component 24 toward handle component 22, whereby component 24 exerts a clamp force on rim structure 18. Reverse rotation of nut 28 unclamps component 24 from the rim structure.

Handle component 22 is a one piece plastic molding that includes a central bridge section 30, a downwardly extending hand grip section 32, and a downwardly extending container—engagement section 34 spaced from section 32 to permit the user's fingers to occupy free space 36. Section 34 is designed to abut against the outer surface of container side wall 16.

Clamping component 24 is a one piece metal casting having a C-cross section (FIG. 1). The metal casting has a substantial thickness dimension normal to the plane of the paper (FIG. 1), e.g. one inch. Component 24 defines an internal cavity 38 whose surface is adapted to encircle rim structure 18. Flange 40 underlies structure 18 to provide vertical support for container 12.

Threaded connector means 26 comprises an elongated bolt 29 having a non-circular head 27 located in a non-circular recess in the rightmost face of component 24; the shank area of the bolt has a press fit in a hole drilled through component 24. Bolt 29 has a slidable fit in a hole formed in the bridge section of handle component 22, such that clamping component 24 can slide toward or away from component 22 when nut 28 is turned.

To clamp the handle structure onto container 12 clamping component 24 is positioned in the dotted line location (FIG. 1), after which nut 28 is rotated to draw component 24 toward the full line position. Component 24 exerts a horizontal clamp force on the inner surface of ring structure 18. Due to the concave contour on the rim 18 inner surface the associated clamp surface will be spaced a slight distance from the rim surface in the median plane of component 24. Handle component 22 preferably includes an upstanding wall structure 44 having a vertical groove 46 therein designed to snugly receive the handle area of a paint brush 48 (shown fragmentarily in FIG. 1). The intent is to support the brush in a prone position, with the bristle area directly above the opening in container 12, whereby paint can safely drip from the brush into the container. The confronting groove 46 surface areas frictionally grip the handle of the paint brush to prevent the brush from toppling over into container 12.

Clamping component 24 preferably includes an integral cover opener means (pry arm) 50 having a relatively thin tip area designed to enter into the small clearance space between the peripheral edge of cover 20 and the upper edge of the container side wall (FIG. 2). Manual force in the arrow 52 direction (FIG. 2) releases the cover from container 12.

FEATURES OF THE INVENTION

An important feature of our invention is the positive clamp action provided by bolt 29 and nut 28. Clamping component 24 is a rigid metal casting that will not deform during service. This contrasts with the elastic clamping mechanism 12C in aforementioned U.S. Pat. No. 2,788,153; that mechanism is required to resiliently widen and then contract in order to snap over rim structure 10B of the paint container.

Only a relatively small clamping force can be achieved with the arrangement of U.S. Pat. No. 2,788,153. The screw operation employed in our system provides a mechanical advantage that achieves an increased clamp action.

Our threaded connector means is also advantageous in that it is easily operated (turned) with a relatively small turning force (the mechanical advantage enjoyed by a screw). In the device of U.S. Pat. No. 2,788,153 a considerable manual force is required to pull clamp mechanism 12C onto rim structure 10B; application of such a large pulling force could upset the paint container.

Our arrangement has the further advantage that container-engagement section 34 has substantial engagement with container side wall 16, at the top edge of the container and also downwardly along the container side surface. In the device shown in U.S. Pat. No. 2,788,153 the handle structure contacts the container side wall only at the upper edge of the container. Our handle structure has an extensive and rigid connection with the container; there is no play or wobble between the handle structure and container. In the device of U.S. Pat. No. 2,788,153 the handle structure can swing freely in a vertical plane around the imaginary center point of accurate hook 12C; considerable wobble or play is possible.

Our invention can be practiced in various different ways, especially in regard to the construction of connector means 26. For example, bolt 29 could be reversed end for-end, with its threaded section mated to a threaded hole in clamping component 24; bolt rotation would then move component 24 to or from its clamping position.

We claim:

1. In association with an open-topped container for liquid coating material, said container having an annular side wall that terminates in an inwardly radiating rim structure circumscribing a central opening for withdrawal of the contained liquid material;

the improvement comprising a handle structure to facilitate manipulation of the container during brush application of the coating material onto an uncoated surface; said handle structure comprising a handle component, a separate clamping component, and a threaded connector means operable to draw the clamping component toward the handle component;

said handle component being a one piece molded plastic member that includes a horizontal bridge section (30), a downwardly-depending pistol hand grip section (22) at one end of said bridge section, and a downwardly-depending container-engagement section (34) at the other end of said bridge section; said container-engagement section being horizontally spaced from the hand grip section so that an intervening space is formed for the user's fingers that extend around the hand grip section, said horizontal bridge section having a horizontal circular hole extending completely therethrough in the zone above the hand grip section and container-engagement section;

said clamping component comprising a three dimensional body (24) having a C-cross section when viewed in a vertical plane coincident with the horizontal hole in the handle component; said C-cross sectioned body including a vertically thickened upper section having an undersurface adapted to seat on the upper surface of the container rim structure, a downwardly-extending web section depending from said vertically thickened section for disposition within the container, and a horizontal flange (40) extending from the lower end of said web section so that it can underlie the container rim structure;

said threaded connector means comprising an elongated horizontal bolt (29) fixedly and permanently attached to said clamping component; said bolt having a non-circular head (27) located in a non-circular socket in the upper section of the clamping component body, and a threaded shank extending horizontally through the upper section of the clamping component body so that said shank is spaced above the undersurface of said upper section when the clamping is operatively seated on the container rim structure; said elongated bolt being adapted to have its shank extend completely through the horizontal hole in the bridge section of the handle component body; and a wing nut (28) threadable onto a threaded end of said bolt, to thereby draw the bolt and attached clamping component toward the bridge section of the handle component; said clamping component being horizontally spaced from the handle component whereby coating material adhering to the clamping component will have difficulty in reaching the interface between the bolt and handle component.

* * * * *